US006640702B2

(12) United States Patent
Watanabe et al.

(10) Patent No.: US 6,640,702 B2
(45) Date of Patent: Nov. 4, 2003

(54) STENCIL PRINTING MACHINE AND METHOD OF CONTROLLING THE SAME

(75) Inventors: Hiroshi Watanabe, Ibaraki-ken (JP); Yoshikazu Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 61 days.

(21) Appl. No.: 09/849,488

(22) Filed: May 7, 2001

(65) Prior Publication Data

US 2001/0052298 A1 Dec. 20, 2001

(30) Foreign Application Priority Data

May 12, 2000 (JP) ..... P2000-140393

(51) Int. Cl.[7] ..... B41F 15/04

(52) U.S. Cl. ..... 101/115; 101/116; 101/128.4; 101/129

(58) Field of Search ..... 101/115, 116, 101/128.4, 129, 119

(56) References Cited

U.S. PATENT DOCUMENTS 5,375,516 A * 12/1994 Hasegawa ..... 101/116
5,735,202 A * 4/1998 Sakakibara et al. ..... 101/2
6,334,387 B1 * 1/2002 Motoe ..... 101/116
6,374,730 B1 * 4/2002 Kuratani et al. ..... 101/115

FOREIGN PATENT DOCUMENTS

EP 1 093 931 A 4/2001

* cited by examiner

*Primary Examiner*—Ren Yan
(74) *Attorney, Agent, or Firm*—Gary M. Nath; Harold L. Novick; Marvin C. Berkowitz

(57) ABSTRACT

A stencil printing machine is provided as including first and second printing drums 25 and 26 carrying thereon respective screens30, a press drum 27 located in close proximity to the printing drums and a stencil making unit 9. In a control method, the stencil making unit 9 supplies a perforated stencil sheet 11*a* onto a selected printing drum 25 and a non-perforated stencil sheet 11*b* onto a non-selected printing drum 26, wherein a print sheet 41 clamped to the press drum 27 is transferred along an outer periphery of the press drum 27 to allow the perforated stencil sheet of the first printing drum 25 to transfer printing ink with a first color to the print sheet 41 while the non-perforated stencil sheet mounted onto the second printing drum prevents printing ink to be transferred to the print sheet 41.

11 Claims, 7 Drawing Sheets

STENCIL PRINTING MACHINE AND METHOD OF CONTROLLING THE SAME

BACKGROUND OF THE INVENTION

1. Field of the Invention

The present invention relates to stencil printing machines and more particularly to a stencil printing machine equipped with plural printing drums for achieving a multi-color printing and a method of controlling the same.

2. Description of the Related Art

Various research and development work have been undertaken to provide a stencil printing machine of the type which enables a multi-color printing with the use of a plurality of printing drums, a first typical example of which is disclosed in FIG. 6 which shows a part of a structure of the prior art stencil printing machine. In FIG. 6, first and second printing drums 101 and 102 and a press drum 103 are rotatably supported in a frame body (not shown) such that the first and second printing drums 101 and 102 are located in close proximity to an outer periphery of the press drum 103 and are angled at 90 degrees relative to a central axis of the press drum 103. Outer circumferential peripheries of the respective first and second printing drums 101 and 102 carry thereon stencil clamping bases 101*a* and 102*a*, respectively, which support thereon sheet clamping segments 101*b* and 102*b* for clamping stencil sheets (not shown) onto the stencil clamping bases 101*a* and 102*a*, respectively.

Further, screens 105 are wound on the outer circumferential peripheries of the first and second printing drums 101 and 102 in a stretched state with the use of the stencil clamping bases 101*a* and 102*a* and springs 104 and 105, with each of the screens 105 being formed of a porous or mesh structure which allows printing ink to permeate. Inner press rollers 106 and 107 are located inside the screens 105 of the first and second printing drums 101 and 102, respectively, with the inner press rollers 106 and 107 being moveable between a wait position not to press the screens 105 and a press engagement position to press the screens 105.

During printing operation, the inner press rollers 106 and 107 are maintained in the press position, in which the screens 105 are expanded outward. Also, it is arranged such that the screen 105 of the first printing drum 101 is supplied with printing ink in a first color by the inner press roller 106 and the screen 105 of the second printing drum 102 is supplied with printing ink in a second color by the inner press roller 107. The outer circumferential periphery of the press drum 103 is provided with a print sheet clamp segment 109, for clamping a leading edge of a print sheet 108, which clamps the leading edge of the print sheet 108 transferred from a paper feed section 110 and release the leading edge of the print sheet 108 at a position in the vicinity of an inlet portion of a sheet discharge section 111.

Now, the stencil printing machine thus arranged operates as follows. A leading edge of a first stencil sheet, which has been made on the basis of image data in a first color of an original is clamped with the sheet clamp segment 101*b* of the first printing drum 101, and a leading edge of a second stencil sheet, which has been made on the basis of image data in a second color of the original, is clamped with the sheet clamp segment 102*b* of the second printing drum 102, with the stencil sheets being mounted onto the outer circumferential peripheries of the respective screens 105.

Next, the first and second printing drums 101 and 102 and the press drum 103 are rotated in synchronism with one another in directions as shown by arrows in FIG. 6, thereby causing the print sheet 108 to be transferred between the first printing drum 101 and the press drum 103 from the paper feed section 110. The print sheet 108 thus transferred is clamped with the print sheet clamp segment 109 of the press drum 103, allowing the print sheet to pass along the outer circumferential periphery of the press drum 103 between the first printing drum 101 and the press drum 103. During this passing step of the print sheet, the inner press roller 106 is brought into press engagement with the screen 105 of the first printing drum 101 which is consequently expanded outward, allowing printing ink to be transferred to the print sheet 108 to reproduce a desired image pattern with a first color via a perforated image area of the first stencil sheet.

The print sheet 108, which has passed between the first printing drum 101 and the press drum 103, then passes between the second printing drum 102 and the press drum 103. During this passing step of the print sheet, the inner press roller 107 is brought into press engagement with the second screen 105 which is consequently expanded outward, allowing printing ink to be transferred to the print sheet 108 to reproduce a desired image pattern with a second color via a perforated image area of the second stencil sheet. As the sheet clamp segment 109 of the press drum 103 is rotated to a position near the inlet of the sheet discharge section 111, the sheet clamp segment 109 is released, with the released print sheet 108 being discharged to the given discharge position by the sheet discharge section 111. In this manner, two-color printing is completed.

A second prior art stencil printing machine is shown in FIG. 7, which is a schematic view of a part of the structure of the stencil printing machine. In FIG. 7, first and second printing drums 101 and 102 are rotatably supported in a frame body (not shown), and outer circumferential peripheries of the first and second printing drums 101 and 102 carry thereon stencil clamping bases 101*a* and 102*a*, respectively, which support thereon sheet clamping segments 101*b* and 102*b* for clamping stencil sheets (not shown) onto the stencil clamping bases 101*a* and 102*a*, respectively.

Further, the outer circumferential peripheries, except the first and second sheet clamping bases 101*a* and 102*a*, of the first and second printing drums 101 and 102 are constructed by respective porous structures that allow printing ink to permeate. Inside the first and second printing drums 101 and 102, respective printing ink supply means are located to supply printing ink, in first and second colors, to the outer circumferential peripheries of the first and second printing drums, respectively.

Also, press rollers 120 and 121 are rotatably supported in close proximity to the first and second printing drums 101 and 102, respectively.

The press rollers 120 and 121 are moveable between a wait position (shown by a solid line in FIG. 7) in which the press rollers 120 and 121 are held out of press engagement with the outer circumferential peripheries of the first and second printing drums 101 and 102, respectively, and a press engagement position (shown by a phantom line in FIG. 7) in which the press rollers 120 and 121 are brought into press engagement with the outer circumferential peripheries of the first and second printing drums, respectively. During printing operation, the inner press rollers 120 and 121 are maintained in the press engagement position. A paper feed section 122 is arranged to supply a print sheet 108 between the first printing drum 101 and the press roller 120, and a sheet discharge section 123 receives the print sheet 108 discharged between the second printing drum 102 and the press roller 121, thereby discharging it to a given position.

Now, the stencil printing machine thus arranged operates as follows. The leading edge of the stencil sheet made on the basis of image data in a first color and the leading edge of the stencil sheet made on the basis of image data in a second color are clamped with the sheet clamp segment 101*b* of the first printing drum 101 and the sheet clamp segment 102*b* of the second printing drum 102, respectively, causing the stencil sheets to be mounted onto the outer circumferential peripheries of the respective printing drums. Next, the first and second printing drums 101 and 102 and the press rollers 120 and 121, which are held in the press engagement position, are rotated in synchronism with one another in directions as shown by arrows in FIG. 7, thereby causing the print sheet 108 to be transferred between the first printing drum 101 and the press roller 120 from the paper feed section 122. The print sheet 108 thus transferred is imparted with a transfer force with rotation of the first printing drum 101 and the press roller 120 and passes between the first printing drum 101 and the press roller 120. During such a passing step of the print sheet 108, printing ink in the second color is transferred to the print sheet 108 via a perforated image area of the stencil screen (not shown). The print sheet 108, which has passed between the first printing drum 101 and the press roller 120, is further transferred between the second printing drum 102 and the press roller 121, with the print sheet 108 being imparted with a transfer force with rotation of the first printing drum 101 and the press roller 120 such that the print sheet 108 passes between the second printing drum 102 and the press roller 121. During traveling of the print sheet, the print sheet 108 is pressed with the press roller 121 such that printing ink in the second color is reproduced on the print sheet 121 in a desired image. Finally, the print sheet 108, which has passed between the second printing drum 102 and the press roller 121, is discharged with the sheet discharge section 123 into the given position. Thus, the two-color printing operation is completed.

SUMMARY OF THE INVENTION

By the way, in the first and second prior art stencil printing machines, printing in a single-color printing mode with the use of either one of plural printing drums encounters problems as described below. That is, in the first prior art practice, a perforated stencil sheet, which has been made in a stencil making step, is mounted only onto a selected one of the printing drums for printing with a selected color, i.e., for example, only onto the first printing drum 101 whereas the stencil sheet is not mounted onto the non-selected printing drum and the inner press roller 107 in the wait position, thereby executing printing operation to perform the single color printing.

However, the print sheet 108, whose leading edge is clamped with the sheet clamp segment 109, is transferred along the outer circumferential periphery of the press drum 103 and a trailing edge of the print sheet 108 is caused to separate from the outer circumferential periphery of the press drum 103 and is brought into contact with the screen 105 whereby the print sheet 108 is stained with ink. Although the non-selected printing drum, i.e., for example, the second printing drum 102 may be taken out from the frame body and the printing operation may be carried out to obtain a stainless single-color printing, troublesome work is undesirably required for taking out the non-selected printing drum from the frame body.

On the other had, in the second prior art stencil printing machine, since each of the press rollers 120 and 121 forms part of the sheet transfer means for the print sheet 108, the press roller 121 associated with the non-selected printing drum, i.e., for example, the second printing drum 102 should also be maintained in the press engagement position. However, when the press roller 121 associated with the non-selected printing drum, i.e., the printing drum 102, remains in the press engagement position, a large quantity of printing ink is necessarily adhered to both the press roller 121 and the print sheet 108. Consequently, it is impossible to carry out the single-color printing without troublesome work such as replacement of the non-selected printing drum with another printing drum on which printing ink is not adhered. Also, similar issues are encountered in other stencil printing machines where more than three printing drums are employed and it is contemplated to perform printing with the number of printing colors less than the number of the printing drums.

The present invention has been made to address various issues encountered in the prior art practices and has an object of the present invention to provide a stencil printing machine which enables printing in printing colors less in number than that of printing drums in an easy manner without causing any troublesome work.

According to a first aspect of the present invention, there is provided a stencil printing machine comprising a plurality of printing drums each formed with a porous structure to allow printing ink to permeate, a stencil making unit for making perforated stencil sheets each having a perforated image area formed on the basis of a color original and selectively making a non-perforated stencil sheet, with the perforated stencil sheets being supplied to and mounted on the printing drums, respectively, and a rotary printing press member located in close proximity to outer circumferential peripheries of the printing drums. A print medium is fed between the printing drums and the rotary printing press member such that the print medium is exerted with given printing pressure to cause the printing ink to permeate through perforated image areas of the stencil screens to transfer the printing ink onto the print medium with a desired image pattern. The stencil making unit allows the perforated stencil sheet to be mounted onto selected one of the printing drums, while allowing the non-perforated stencil sheet to be mounted onto the non-selected remaining one of the printing drums, thereby preventing the printing ink to permeate from the remaining one of the printing drums onto the print medium.

According to a second aspect of the present invention, there is provided a stencil printing machine comprising a frame body, a plurality of printing drums rotatably supported in the frame body and each including cylindrical porous structures to allow printing ink to permeate, a stencil making unit for making a perforated stencil sheet having a perforated image area formed on the basis of a color original and selectively making a non-perforated stencil sheet, with the perforated stencil sheet being supplied to and mounted onto the selected one of the printing drums, ink supply means for supplying printing ink to the plurality of printing drums, a rotary printing press member rotatably supported in the frame body in the vicinity of outer circumferential peripheries of the printing drums, and a paper feed section located in the frame body in the vicinity of the rotary printing press member for supplying a print medium between the printing drums and the rotary printing press member to allow printing ink to be transferred from the printing drums through the perforated image area to reproduce a desired image on the print medium. The stencil making unit allowing the perforated stencil sheet to be mounted onto selected one of the printing drums while allowing the non-perforated stencil sheet to be mounted onto the remaining non-selected printing drum, thereby preventing the printing ink to permeate from the remaining non-selected printing drum onto the print medium.

According to a third aspect of the present invention, there is provided a method of controlling a stencil printing machine having a plurality of printing drums each having a cylindrical porous structure to allow printing ink to permeate, and a rotary printing press member located in the vicinity of outer circumferential peripheries of the printing drums. The method comprises making a perforated stencil sheet having a perforated image area formed on the basis of a color original and a non-perforated stencil sheet, mounting the perforated stencil sheet onto selected one of the printing drums, mounting the non-perforated stencil sheet onto the non-selected printing drum for non-printing, supplying printing ink to the plurality of printing drums, and supplying a print medium between the printing drums and the rotary printing press member to allow printing ink to be transferred from the selected one of the printing drums through the perforated image area of the perforated stencil sheet to the print medium to reproduce a desired image thereon. During printing, the non-perforated stencil sheet is mounted on the non-selected printing drum to prevent printing ink to be transferred to the print medium.

BRIEF DESCRIPTION OF THE DRAWINGS

The invention, together with objects and advantages thereof, may best be understood by reference to the following description of the presently preferred embodiments together with the accompanying drawings, in which.

DETAILED DESCRIPTION OF THE PREFERRED EMBODIMENTS

Figure 1:
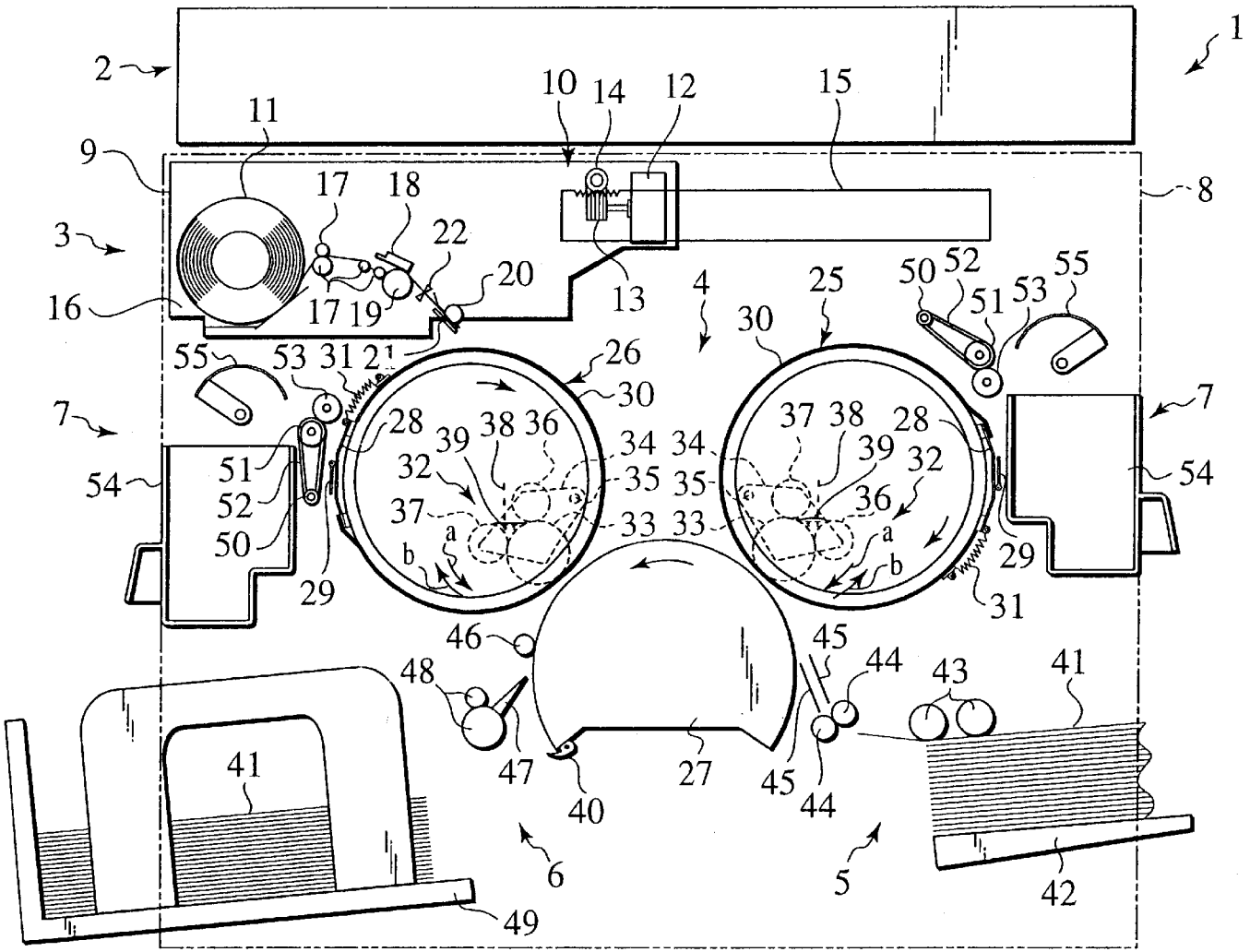
FIG. 1 is a schematic structural view of a first preferred embodiment of a stencil printing machine according to the present invention.
Figure 2:
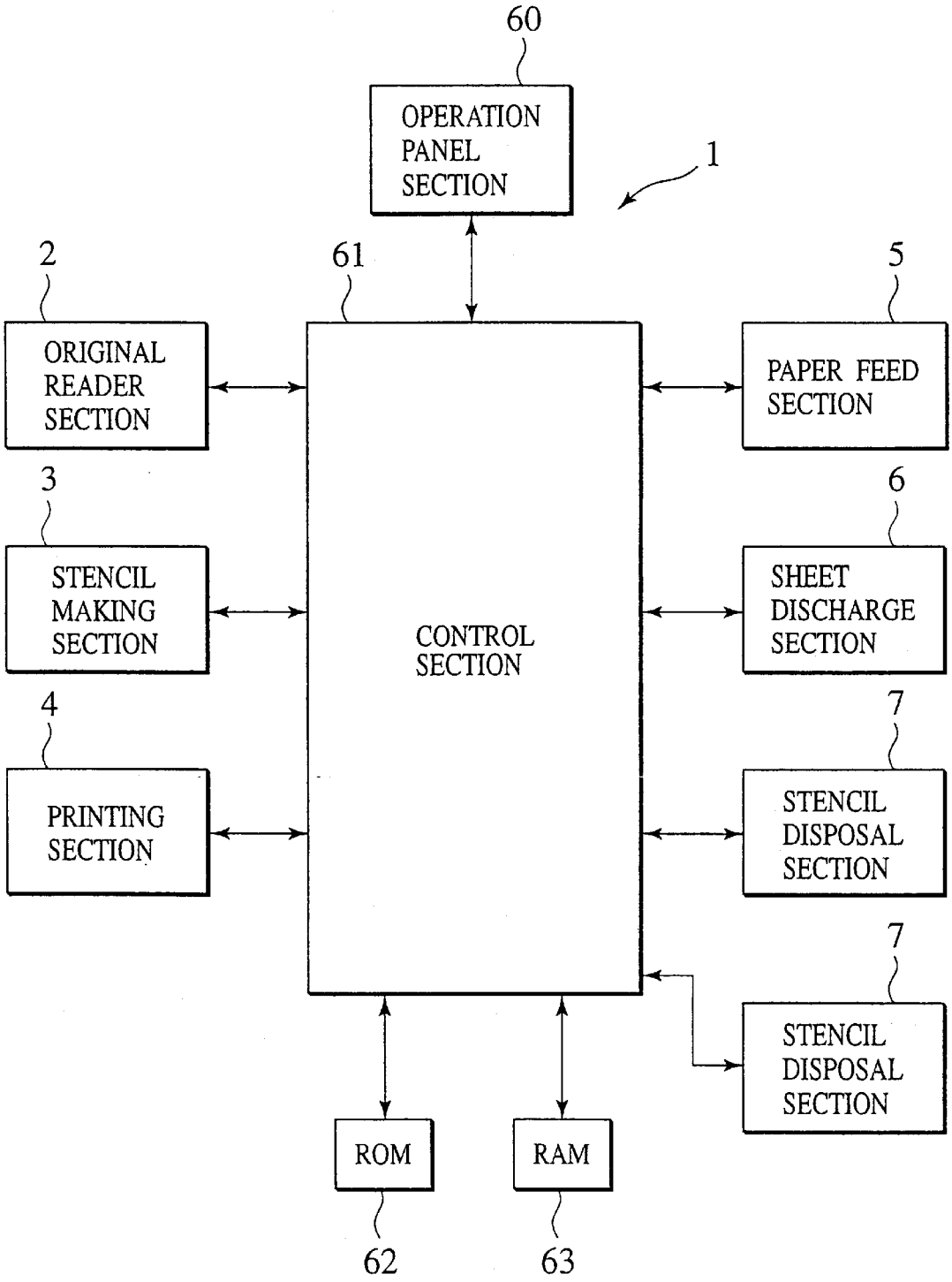
FIG. 2 is a block diagram of a schematic electric circuit of the first preferred embodiment of the stencil printing machine according to the present invention.
Figure 3:
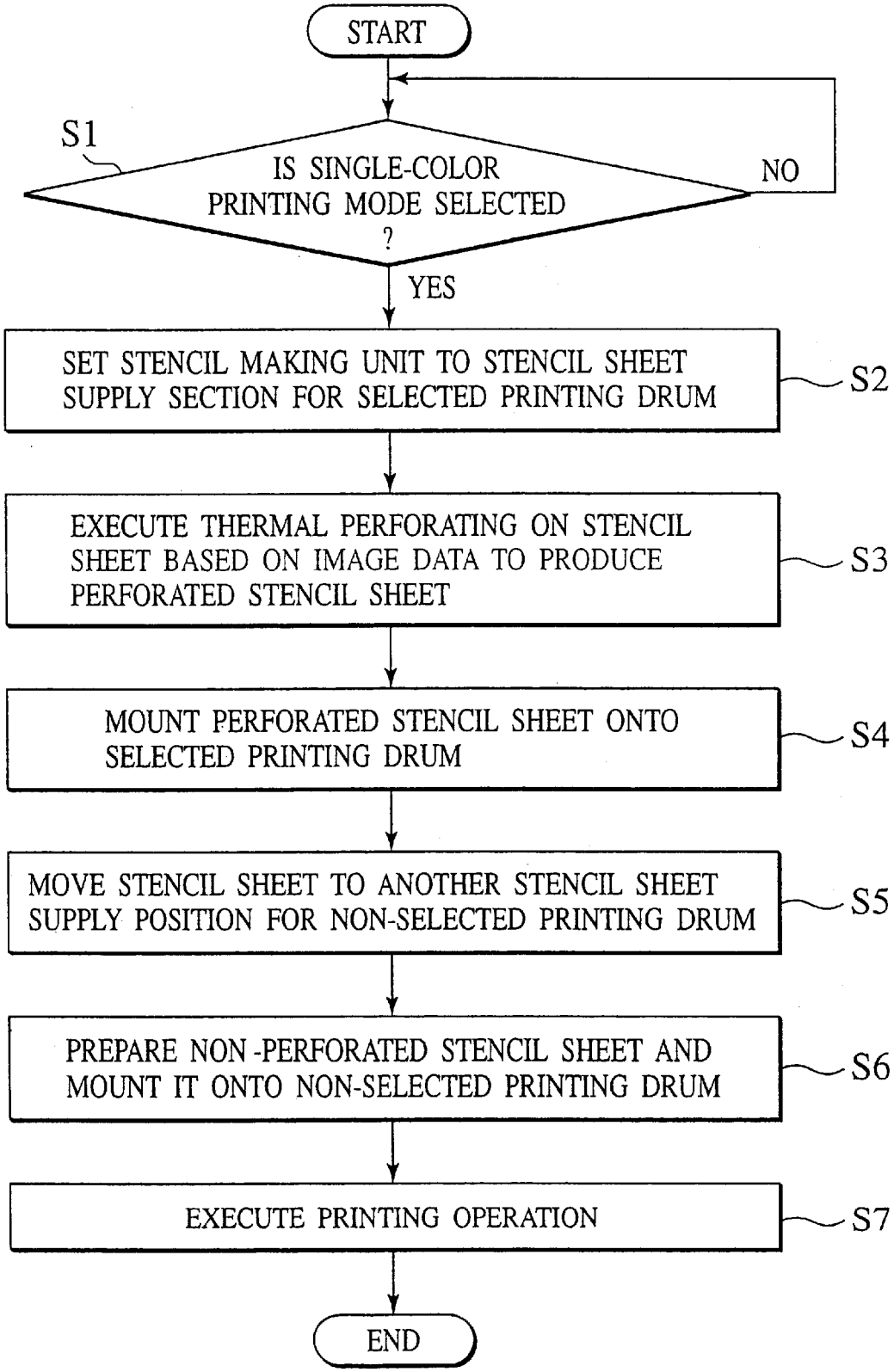
FIG. 3 is a general flow diagram for illustrating the basic sequence of operations, for a single color printing, which are executed by a control section of the stencil printing machine according to the present invention.
Figure 4:
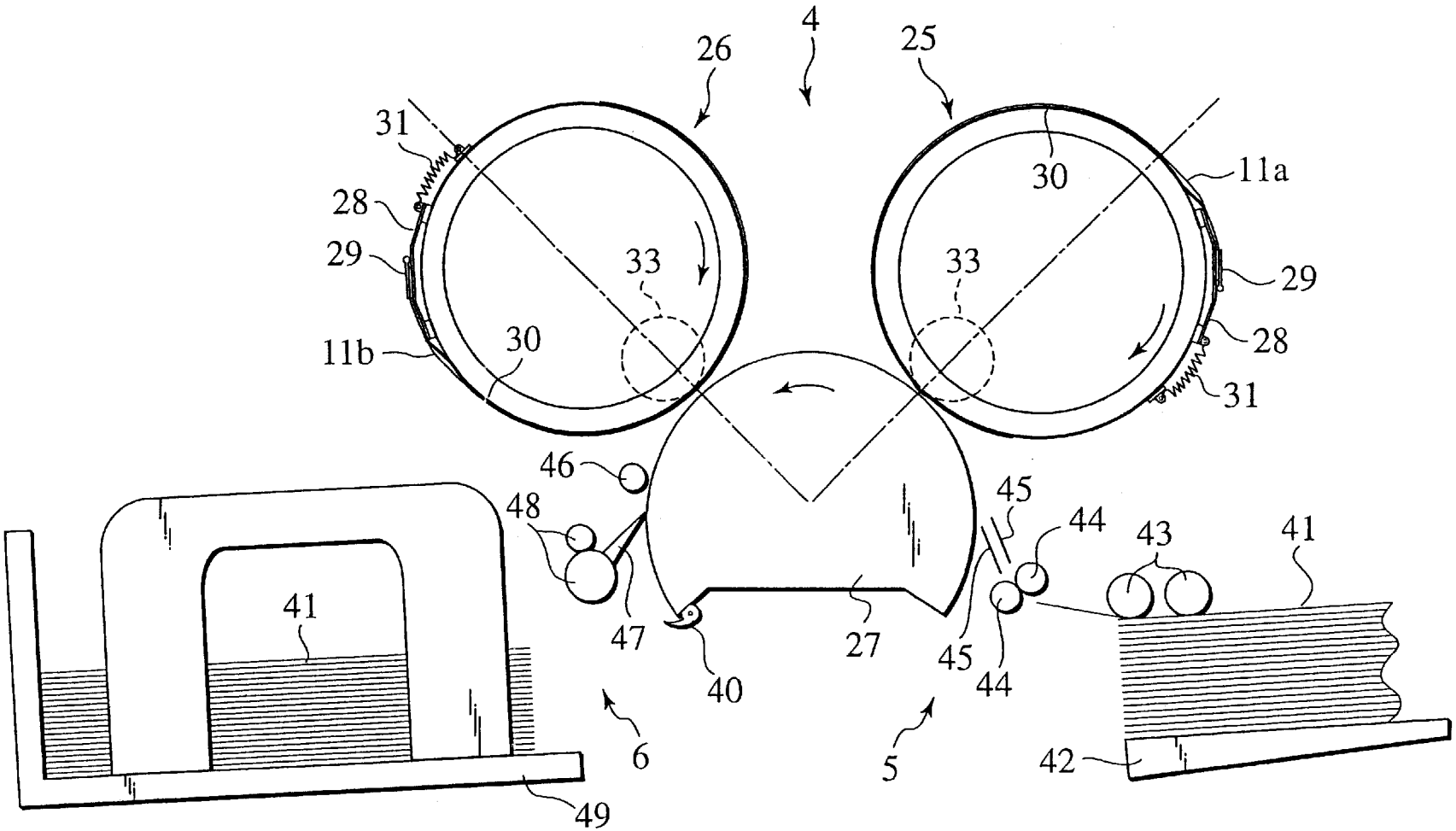
FIG. 4 is a schematic structural view of the stencil printing machine which is selected for performing a single color printing.

Referring to FIGS. 1 to 4, there is shown a first preferred embodiment of a stencil printing machine according to the present invention, wherein FIG. 1 is a schematic structural view of the stencil printing machine 1, FIG. 2 is a schematic, circuit block diagram of the stencil printing machine 1, FIG. 3 is a general flow diagram for illustrating the basic sequence of operations which are executed when a single-color printing mode is selected, and FIG. 4 is an enlarged schematic view of certain components of the stencil printing machine 1, showing operative principles of the single-color printing mode.

Structure of Stencil Printing Machine

In FIG. 1, the stencil printing machine 1 is mainly constructed of an original reader section 2, a stencil making section 3, a printing section 4, a paper feed section 5, a sheet discharge section 6, and stencil disposal sections 7 mounted at two locations, and functions to operate in a first single-color printing mode and a second two-color printing mode.

Original Reader Section

The original reader section 2 is located above a frame body 8 and reads an image pattern, as input image data of a color original to produce a train of electric signals. The train of electric signals are processed to produce output image data signals to be reproduced in printing ink with first and second colors for first and second printing drums. Also, in this event, the output image data signals can be further processed on the basis of given commands (i.e., commands for scale up or scale down, etc.).

Stencil Making Section

The stencil making section 3 includes a stencil making unit 9 located in an upper portion of the frame body 8 for horizontal movement. The stencil making-unit 9 is moveable with a stencil making unit transfer device 10 between a first stencil sheet feeder position to allow a perforated stencil sheet 11 to a first printing drum 25 and a second stencil sheet feeder position (i.e., a position shown in FIG. 1) to allow a non-perforated stencil sheet 11 to a second printing drum 26. The stencil making-unit transfer device 10 is constructed having a stencil making-unit transfer motor 12, a worm gear 13 fixed to a rotary shaft of the stencil sheet making-unit transfer motor 12, a worm wheel (not shown) meshing with the worm gear 13, a pinion gear 14 connected to the worm wheel at an central axis thereof, and a rack 15 fixedly mounted to the machine frame 8. The stencil making unit 9 includes a stencil sheet roll container 16 which receives an elongated stencil sheet 11 formed in a rolled shape, a plurality of feed rollers 17 adapted to guide a leading edge of the stencil sheet 11 received in the stencil sheet roll container 16 toward a downstream side, a thermal printing head 18 located at a downstream side of the feed rollers 17, a platen roller 19 which is located in an opposed position of the thermal printing head 18 and which rotates with drive force exerted by a pulse motor (not shown), a stencil sheet feed roller 20 located at a downstream side relative to the platen roller 19 and the thermal printing head 18 and adapted to be driven with the drive force of the pulse motor, a guide plate 21 to which the stencil sheet feed roller 20 is held in contact in a pressurized relationship, and a stencil sheet cutter 22 located between the stencil sheet feed roller 20 and the guide plate 21, and the platen roller 19 and the thermal printing head 18.

Printing Section

The printing section 4 includes a first printing drum 25, a second printing drum 26, and a press drum 27, which serves as a rotary printing press member to impart printing pressure, with both the first and second printing drums 25 and 26 being located above the press drum 27 in right and left directions at obliquely oriented positions. In particular, the first and second printing drums 25 and 26 are placed in close proximity to an outer circumferential periphery of the press drum 27 at positions angled 90 degrees relative to a central axis of the press drum 27. The first and second printing drums 25 and 26 and the press drum 27 are rotatably supported in the frame body 8, and are rotated with a printing drum rotating mechanism (not shown) at the same circumferential speeds, as shown by arrows in FIG. 1, in the vicinities of a first contact zone between the first printing drum 25 and the press drum 27 and a second contact zone between the second printing drum 26 and the press drum 27. The printing drum rotating mechanism is driven with a main motor (not shown) which serves as a drive source.

The first and second printing drums 25 and 26 have respective annular frame pairs (bearing no reference numerals) which are interconnected with stencil clamping bases 28, forming respective parts of outer circumferential peripheries of the first and second printing drums 25 and 26, respectively. The stencil clamping bases 28 have respective stencil clamping segments 29, by which leading edges of the stencil sheets 11 are clamped. Also, a leading edge of a screen 30 is fixed to each of the stencil clamping bases 28, with each screen 30 being wound on each of outer circumferential peripheries of the first and second printing drums 25 and 26.

An end portion of each screen 30 is stretched over each of the stencil clamping bases 28 by a spring 31, with each screen 30 being arranged to be expandable outward against the force of the spring 31. Each screen 30 is constructed of, for example, a mesh-shaped porous structure which, when it is pressed with an inner press roller 33, which will be discussed below, permits printing ink 38 to permeate from inward to outward. Thus, each screen 30 forms each outer circumferential periphery, which is supplied with printing ink 38, of the first and second printing drums 25 and 26.

Inside each of the screens 30 of the first and second printing drums 25 and 26, an inner press mechanism 32 is accommodated. Each inner press mechanism 32 includes the inner press roller 33 which has a first function in that the screen 30 is pressed from inside for printing, and a second function in that the printing ink 38 is supplied to the screen 30.

Each of the inner press rollers 33 is rotatably supported by a pair of roller support members 34 located at both sides of each press roller and is rotated with a drive means, which is not shown, in synchronism with rotations of the first and second printing drums 25 and 26. The roller support members 34 are supported on a pivot shaft 35 for rotational movement thereabout such that, with rotation of the roller support members 34 in a direction as shown by an arrow a in FIG. 1, the roller support members 34 are moveable between an operative, press engagement position to cause the inner press roller 33 to press an inner periphery of the screen 30, and an inoperative, wait position when the roller support members 34 are rotated in a direction as shown by an arrow b. Each of the inner press rollers 33 assumes the press engagement position during printing operation and the wait position except during printing operation.

Further, the roller support members 34 carry first and second doctor rollers 36 and 37. The first and second doctor rollers 36 and 37 include cylindrical columns, respectively, and both are located in the vicinity of the inner press roller 33. The printing ink 38 is supplied to an outer periphery space of the inner press roller 33, i.e., in an upper space surrounded between the first and second doctor rollers 36 and 37 by an ink supply section (not shown), in which an ink pool 39 is constructed. The first printing drum 25 is supplied with printing ink 38 with a first color, and the second printing drum 26 is supplied with printing ink 38 with a second color.

A gap (an opposing distance) between the first doctor roller 36 and the inner press roller 33 is preset to a value sufficient to cause printing ink to be formed on the inner press roller 33, and a gap between the second doctor roller 37 and the inner press roller 33 is reduced to some extent sufficient to avoid printing ink from being leaked. That is, when the inner press roller 33 rotates, printing ink with a given thickness is continuously adhered to an outer circumferential surface of the inner press roller 33 owing to the gap between the first doctor roller 36 and the press roller 33, allowing the inner press roller 33 to supply printing ink onto the screen 30.

In addition, a print sheet clamp segment 40 is located at a given position of an outer circumferential periphery of the press drum 27, which serves as the rotary member to impart pressure for printing, thereby enabling the clamp segment to clamp an edge of the print sheet 41 which is a print medium.

In such a printing section 4, in the single-color printing mode, the first printing drum 25 is selected for printing in a single color for explanatory purpose and, in this event, it will be hereinafter referred to as "a first selected printing drum", for the sake of clarity, in which a print sheet is printed with printing ink with the single color in the single-color printing mode. In this single-color printing mode, the second printing drum 26 is not selected for printing and, so, it is referred to as "a second non-selected printing drum 26" by which no printing is executed.

Paper Feed Section

The paper feed section 5 is constructed having a paper feed tray 42 on which print sheets 41 each serving as a print medium are stacked, primary paper feed rollers 43, which is kept in press engagement with an uppermost print sheet 41 stacked on the paper feed tray 42, a secondary paper feed roller pair 44 located downstream the primary paper feed rollers 43 and a guide plate pair 45 serving as a transfer guide for the print sheet between the secondary paper feed roller pair 44 and the press drum 27. Rotation of the paper feed rollers 43 causes only the uppermost print sheet 41 on the stack thereof to be transferred to the secondary paper feed roller pair 44, with the transferred print sheet 41 being fed to the printing section 4 in synchronism with the press drum 27 due to rotation of the secondary paper feed roller pair 44.

Sheet Discharge Section

The sheet discharge section 6 includes an upper limit guide segment 46, a sheet separator claw 47, which separates the print sheet 41 from the press drum 27 when the print sheet is not removed, a sheet discharge roller pair 48, which transfers the print sheet 41 guided by the upper limit guide 46 or separated from the sheet separator claw 47, and a paper receiving tray 49 which stacks the print sheets 41, discharged from the sheet discharge roller pair 48, in a stacked state.

Stencil Disposal Sections

The stencil disposal sections 7 are located in the frame body 8 in the vicinities of the first and second printing drums 25 and 26, respectively. Each of the stencil disposal sections 7 includes a pair of stencil discharge rollers 50 and 51, which are located in the vicinity of each of the first and second printing drums 25 and 26 in a slightly spaced relationship relative to the outer peripheries thereof, a stencil guide belt 52 which guides a leading edge of the stencil sheet 11 released from the stencil clamp segment 29, a stencil discharge roller 53 which transfers the stencil sheet 11, guided with the stencil guide belt 52, while separating it from each of the first printing drum 25 and the second printing drum 26 in conjunction with the stencil discharge roller 51, a stencil disposal box 54 for receiving the stencil sheets 11 transferred from the stencil discharge rollers 51 and 53, and a stencil compressing plate 55 for compressing the stencil sheets 11 toward rearmost end of the stencil disposal box 54.

Structure of Control System

Now, a control system for the stencil printing machine 1 is described below in detail. As shown in FIG. 2, the body frame 8 is provided with an operation panel 60. The operation panel 60 includes a stencil making/print start key, ten keys for inputting various input data such as the number of print sheets, a single- color printing key, and a display panel section for providing a display of various data (all of which are not shown).

Input data of the operation panel 60 is output to a control section 61 including a microcomputer (CPU) which controls the basic sequence of operations of the original reader section 2, the stencil making section 3, the print section 4, the paper feed section 5, the sheet discharge section 6, and the stencil disposal sections 7 located at the two positions in response to the input data. Also, the control section 61 controls writing in or reading out of ROM 62 and RAM 63 which store therein various control programs such that, when the single-color printing key is operated, operation is executed in a manner for example as shown in a general flow diagram shown in FIG. 3. Details in which control is executed is described below.

Printing Operation and Control Method

Two-color printing operation of the stencil printing machine 1 will be simply described below. In the original reader section 2, the original for printing is read out, producing respective image data for the first printing color available for the first printing drum and the second printing color available for the second printing drum.

In the stencil making section 3, the elongated stencil sheet 11 is transferred with rotations of the platen roller 19 and the stencil sheet feed roller 20 to the thermal printing head 18 at which first and second stencil sheets 11 are thermally perforated, thereby producing the first and second stencil sheets 11 having first and second perforated image areas, which are formed on the basis of the image data read out by the original reader section 2. Trailing edges of the stencil sheets 11, which have the respective perforated image areas, are cut with the stencil sheet cutter 22 for thereby forming the first and second stencil sheets 11 in a given length for printing ink with the first color specified for the first printing drum 25 and for printing ink with the second color specified for the second printing drum 26. In addition, the stencil making unit 9 is moved to the first stencil sheet supply position such that the first stencil sheet 11 formed for printing ink with the first color is supplied onto the first printing drum 25, and the stencil making unit 9 is then moved to a second stencil sheet supply position such that the second stencil sheet 11 formed for printing ink with the second color is supplied onto the second printing drum 26.

In the printing section 4, the leading edge of the first stencil sheet 11 made by the stencil making section 3 is clamped with the stencil sheet clamp segment 29 of the first printing drum 25, with the first printing drum 25 being rotated while clamping the stencil sheet such that the stencil sheet 11 is wrapped around the outer periphery of the screen 30 of the first printing drum 25. Further, the leading edge of the second stencil sheet 11, made by the stencil making section 3, is clamped with the stencil sheet clamping segment 29 of the second printing drum 26, with the second printing drum 26 being rotated while clamping the second stencil sheet such that the second stencil sheet 11 is wrapped around the outer periphery of the screen 30 of the second printing drum 26.

In the paper feed section 5, the print sheet 41 is transferred in synchronism with rotations of the first printing drum 25, the second printing drum 26 and the press drum 27, which are described below, with the leading edge of the print sheet 41 being clamped by the print sheet clamp segment 40 of the press drum 27 to allow, during rotation thereof, the print sheet 11 to be transferred between the first printing drum 25 and the press drum 27.

In the printing section 4, on the other hand, each of the inner press rollers 33 is held in the wait position, except in printing operation, wherein each inner press roller 33 is held out of press engagement with each screen 30. During printing operation, each inner press roller 33 is brought into the operative, press engagement position in each of first and second contact zones to cause each of the first and second printing drums 25 and 26 to rotate with the press drum 27. Then, each inner press roller 33 rotates on the inner periphery of each screen 30 while pressing the inner periphery of the screen 30 in the contact zone. Since, in this instance, printing ink 38 is continuously supplied onto the outer periphery of each inner press roller 33, rotation of the inner press roller 33 transfers printing ink 38 onto the screen 30.

Further, when the inner press roller 33 is brought into press engagement with the screen 30, the screen 30 associated with the inner press roller 33 is expanded toward the outer periphery thereof and is brought into press engagement with the press drum 27 in the contact zone. In addition, as previously noted above, the print sheet 41 is transferred between the first printing drum 25 and the press drum 27 from the paper feed section 5, and the transferred print sheet 41 is further continuously fed under pressure exerted by the screen 30 and the first stencil sheet 11.

Then, the print sheet 41 is transferred between the second printing drum 26 and the press drum 27, and the transferred print sheet 41 is further continuously transferred under pressure exerted by the screen 30 and the second stencil sheet 11. During consecutive transferring steps under pressed conditions, printing ink 38 with the first and second colors is consecutively transferred to the print sheet 41 via the perforated image areas of the first and second stencil sheets 11, thereby completing print in a desired image with two colors. When the leading edge of the print sheet 41 passes across a position near the inner press roller 33 associated with the second printing drum 26 and comes downstream of the above position, the print sheet clamp segment 40 is released.

In the sheet discharge section 6, the leading edge of the print sheet 41 is guided with the upper limit guide 46, or the leading edge of the print sheet 41 is separated from the press drum 27 with the sheet separator claw 47, with a subsequent transfer of the print sheet 41 to the paper receiving tray 49 via the sheet discharge roller pair 48.

In the stencil disposal section 7, further, when beginning to make new stencil sheets, the preceding stencil sheets 11, which have been wound around the outer peripheries of the respective screens 30 of the first and second printing drums 25 and 26, are released from the stencil sheet clamp segments 29 of the first and second printing drums 25 and 26, respectively, such that the released leading edges of the stencil sheets 11 are guided with the stencil guide belts 52 while rotating the first and second printing drums 25 and 26 and the stencil sheets 11 are transferred with the stencil separating roller pairs 51 and 53, respectively, allowing the stencil sheets 11 to be discharged into the stencil disposal boxes 54.

Now, operation of the stencil printing machine 1 in the single-color printing mode will be described with reference to FIGS. 3 and 4. As shown in FIG. 3, at the start, i.e., power is supplied to the stencil printing machine 1. In step S1, the single-color printing key is turned on to select printing ink with a single color to be printed. In this instance, for example, if the printing color for the first printing drum 25 is designated to select the single-color printing mode, the stencil making unit 9 is set to the first stencil sheet supply position associated with the first printing drum 25 (step S2). In this event, if the stencil making unit 9 originally remains at the first stencil sheet supply unit position, the stencil making unit 9 is maintained at that position, whereas, when the stencil making unit 9 originally remains at the second stencil sheet supply position, the stencil making unit 9 is moved to the first stencil sheet supply position associated with the first printing drum 25.

In the next step S3, a first stencil sheet 11 is thermally perforated with the thermal printing head 18 on the basis of image data, producing a perforated stencil sheet 11 having a desired image area. Then in step S4, the perforated stencil sheet 11*a* (with the perforated stencil sheet bearing 11*a* in FIG. 4) is supplied to and mounted onto the selected first printing drum 25 available for printing with the designated single color.

In the next step S5, the stencil making unit 9 is then moved to the second stencil sheet supply position associated with the second non-selected printing drum 26 for non-printing. Then in step S6, the stencil sheet 11 is not thermally perforated such that a non-perforated stencil sheet 11*b* (with the non-perforated stencil sheet bearing 11*b* in FIG. 4) is produced by the stencil making unit 9 and is mounted onto the non-selected second printing drum 26. In the succeeding step S7, the single-color printing operation is executed in the same manner as the two-color printing mode discussed above.

Here, the presence of the non-perforated stencil sheet 11*b* covered on the screen 30 of the non-selected second printing drum 26 avoids the printing ink 38 to be transferred onto the print sheet 41 even when the trailing edge of the print sheet 41 is separated from the outer periphery of the press drum 27 and is brought into contact with the second printing drum 26 due to resilience of the print sheet 41. In addition, it is not required for an operator, who desires to carry out single-color printing, to perform troublesome work such as removing the second non-selected printing drum 26 from the frame body 8. For these reasons, single-color printing can be carried out without any stains caused in the print sheet in an easy manner with less troublesome works.

Further, during single-color printing operation, the inner press roller 33 associated with the second non-selected printing drum 26 for non-printing may be placed in the press engagement position or in the wait position (i.e., the position shown in FIG. 4). Even when the inner press roller 33 is maintained in the press engagement position, an advantage resides in that the single-color printing operation may be implemented in the same manner as the two-color printing operation.

During single-color printing operation, also, the non-selected second printing drum 26 for non-printing may be rotated or may be interrupted in operation. If, in this event, the selected first printing drum 26 for printing is rotated, the single-color printing operation may be implemented in the same manner as the two-color printing operation.

In the first preferred embodiment discussed above, the stencil printing machine 1 includes a single-color printing key, and, when it is depressed to select the single-color printing mode by designating the printing color, the first printing drum 25 or the second printing drum 26, selected for printing with the designated printing color, is wrapped with the first stencil sheet 11*a* which has been perforated on the basis of image data while the first printing drum 25 or the second printing drum 26, non-selected for printing with the designated printing color, is wrapped with the non-perforated stencil sheet 11*a*. As a consequence, the single-color printing operation may be executed by merely turning on the single-color printing key, with a resultant ease of operation in single-color printing.

Also, if the single-color printing mode is selected by designating the printing color available by the second printing drum 26, the perforated stencil sheet 11*a*, which has been formed on the basis of image data, is mounted onto the second selected printing drum 26, whereas the non-perforated stencil sheet 11*b* is mounted onto the non-selected first printing drum 25, thereby implementing the single-color printing operation.

Figure 5:
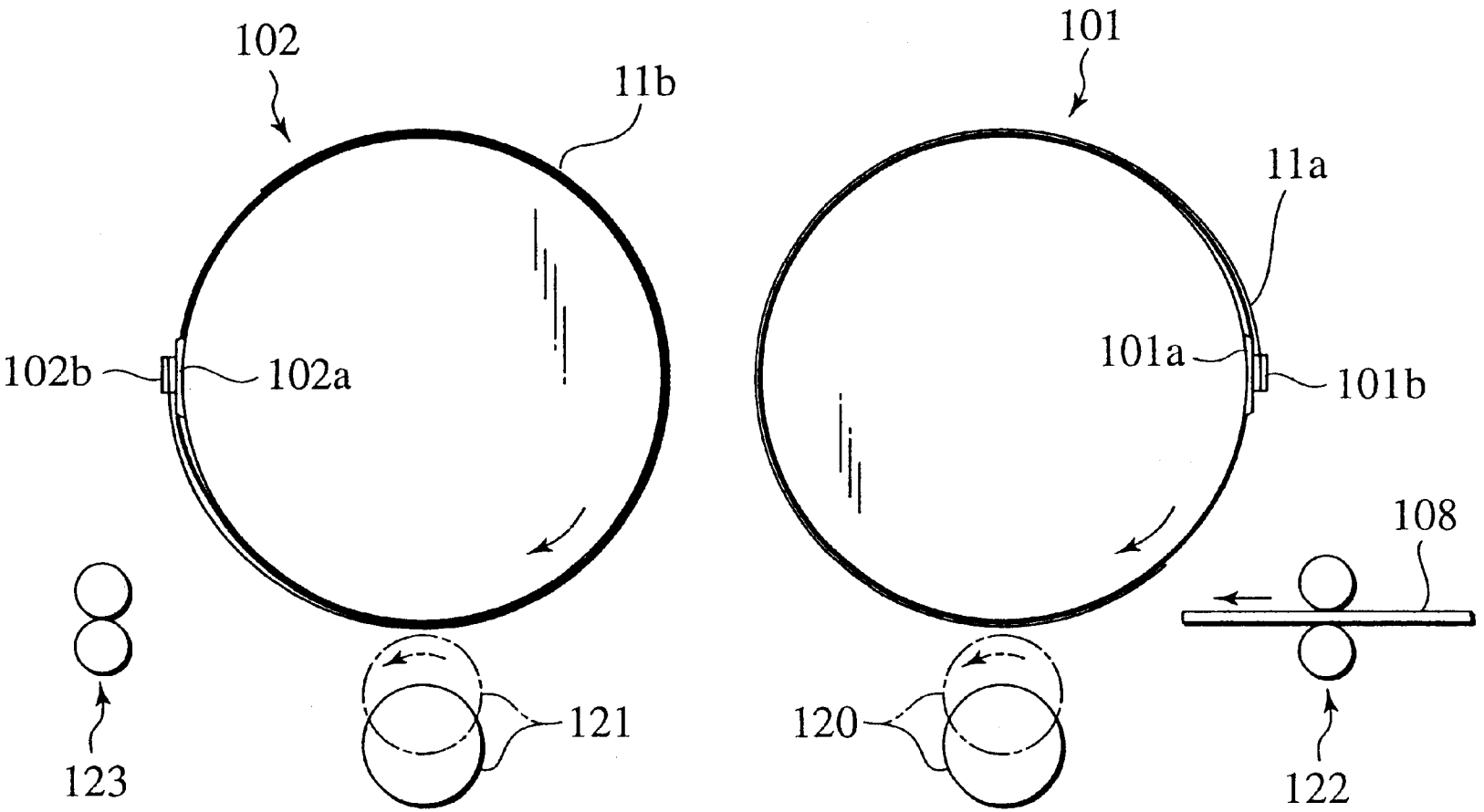
FIG. 5 is a schematic structural view of a second preferred embodiment of a stencil printing machine according to the present invention.
Figure 6:
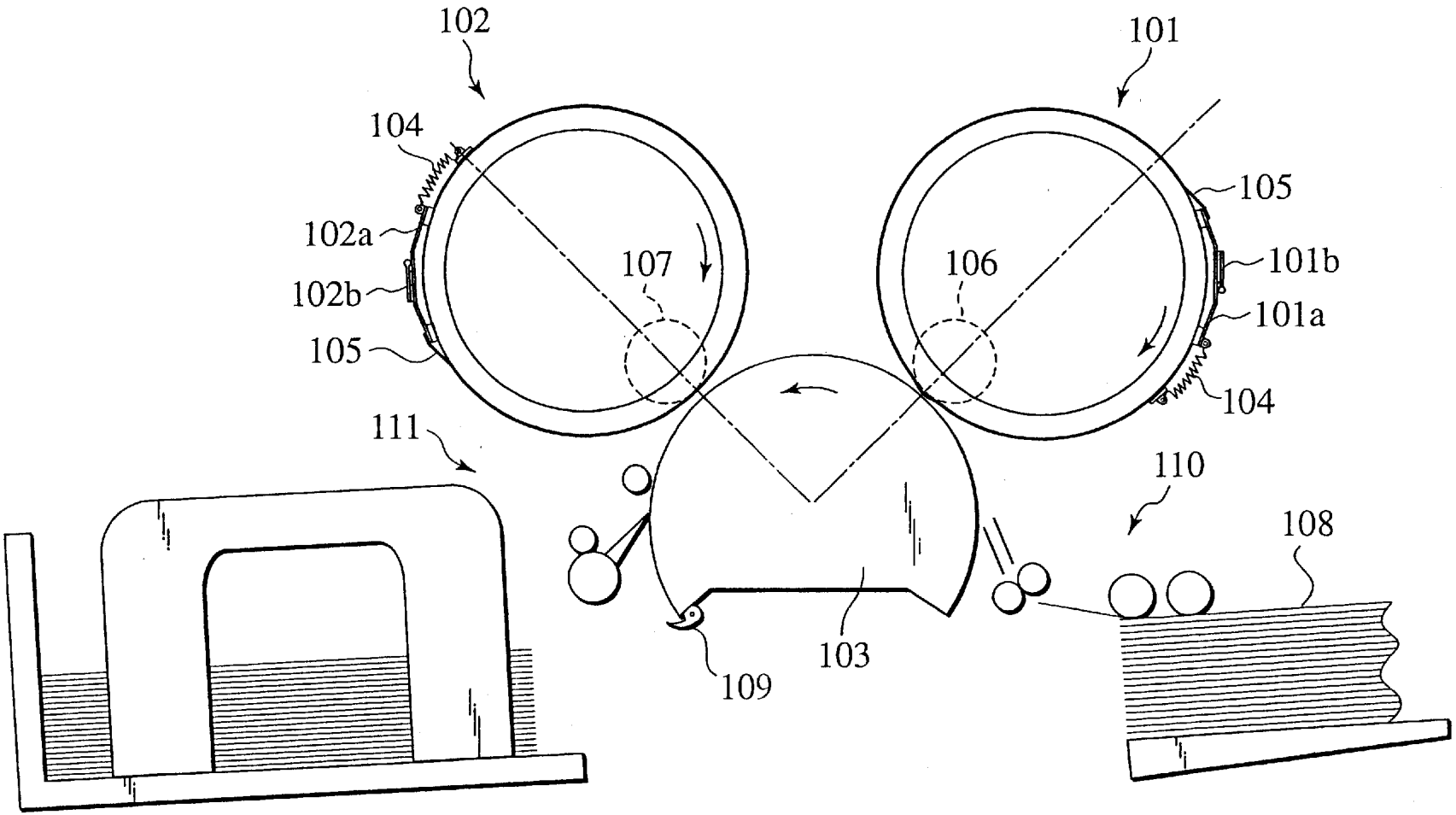
FIG.6 PRIOR ART
FIG. 6 is a schematic structural view of a first prior art stencil printing machine.
Figure 7:
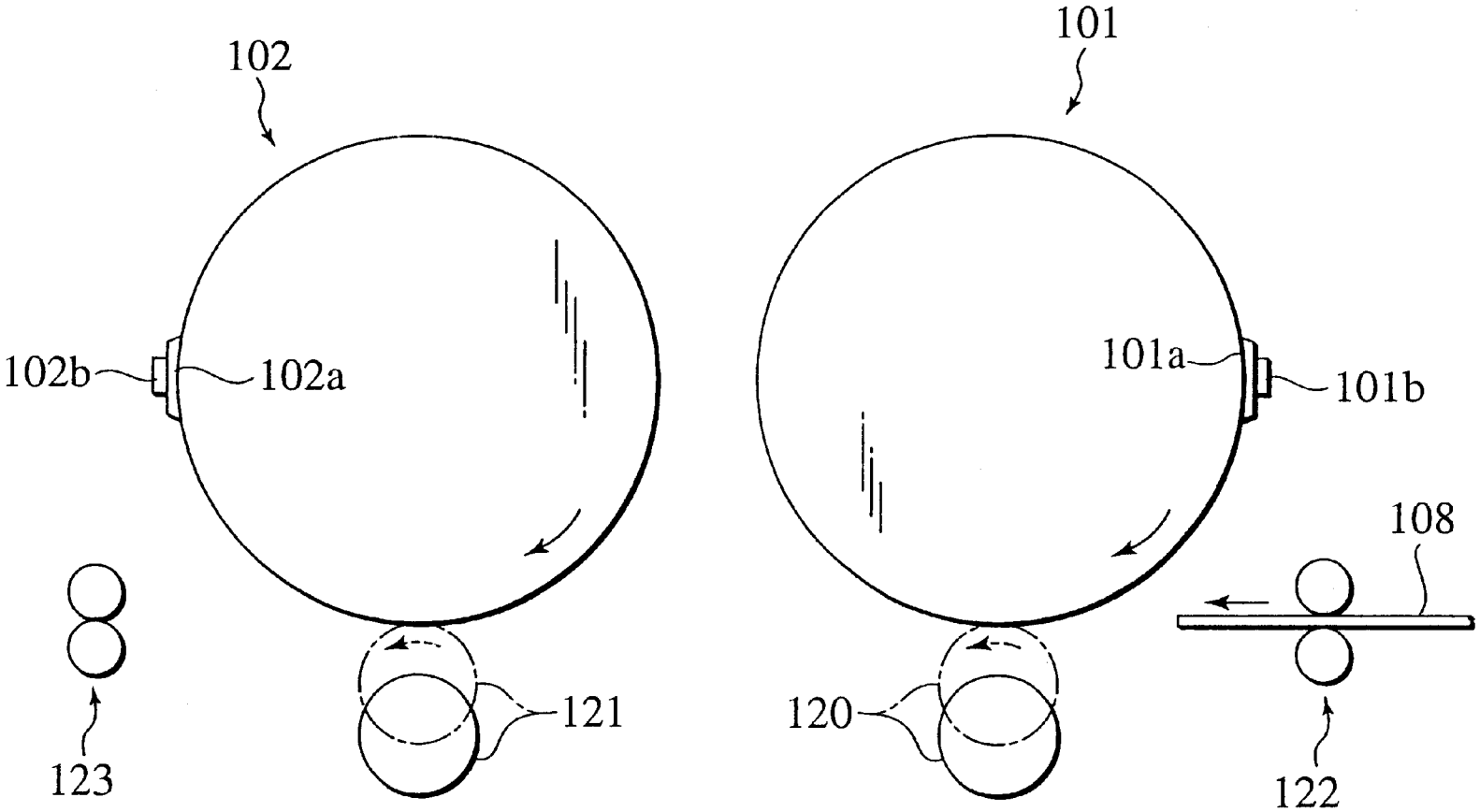
FIG.7 PRIOR ART
FIG. 7 is a schematic structural view of a second prior art stencil printing machine.

FIG. 5 shows a schematic structural view of a part of a second preferred embodiment of a stencil printing machine according to the present invention. In FIG. 5, like parts bear like reference numerals as those used in the aforementioned second prior art to avoid duplicated explanation and an explanation will be given only to parts which do not appear in the prior art. That is, in the second preferred embodiment, the stencil printing machine includes rotary printing press members which are composed of press rollers 120 and 121. When the printing color is designated, i.e., when the printing color available for the first printing drum 101 is designated and a single-color printing mode is selected, the first printing drum 101 is wrapped with the perforated stencil sheet 11*a* (with the perforated stencil sheet bearing a reference numeral 11*a* in FIG. 5), which has been formed on the basis of image data, whereas the non-perforated stencil sheet 11*b* (with the non-perforated stencil sheet bearing a reference numeral 11*b* in FIG. 5) is mounted onto the second non-selected printing drum 26, thereby executing a single-color printing operation.

In such a single-color printing operation, since the outer periphery of the second non-selected printing drum 26 is covered with the non-perforated stencil sheet 11*b*, even when the press roller 121 is held in press engagement with the second printing drum 102, the single-color printing operation may be executed without causing printing ink to be adhered to the press roller 121 or the print sheet 108. In addition, when carrying out the single-color printing operation, operators are not required to work such as replacement of the second printing drum 102 with another one on which printing ink is not adhered. As already noted above, the single-color printing operation may be easily carried out without stains caused in the print sheet and without troublesome works.

Other Preferred Embodiment

In the first and second preferred embodiments, although the stencil printing machines have been described as including two printing drums, assuming that the sum of the number of printing drums is $N(N \geqq 2)$ it is possible for the stencil printing machine to execute printing with the number of printing colors, which is less than the sum of the number of the printing drums, by wrapping a perforated stencil sheet or perforated stencil sheets onto the number of selected printing drums available for the number of printing colors less than (N−1) while wrapping a non-perforated stencil sheet or non-perforated stencil sheets onto the number of non-selected printing drums, thereby allowing printing to be easily carried out without causing stains with printing ink in a print sheet and without troublesome works. In particular, in a stencil printing machine having three printing drums, i.e., first to three printing drums, when it is contemplated to carry out two-color printing with the use of only printing colors available from the first and second printing drums, the first and second printing drums are wrapped with perforated stencil sheets, which have been formed on the basis of image data, and the non-perforated stencil sheet is mounted onto the third printing drum, thereby executing the two-color printing operation. Also, in the stencil printing machine having three printing drums, i.e., first to three printing drums, when it is contemplated to implement the single color printing operation with the use of only printing color available from the selected second printing drum, the second selected printing drum is covered with the perforated stencil sheet, which has been formed on the basis of image data, and the non-perforated stencil sheets are wrapped onto the non-selected first and third printing drums, thereby executing the single-color printing operation.

Also, in the first preferred embodiment discussed above, while the stencil printing machine has been shown as including plural printing drums 25 and 26 and the single press drum 27, the present invention may be applied to the stencil printing machine which has the same number of the rotary press members as that of the printing drums. As previously noted, the present invention may be applicable to all of the stencil printing machines having plural printing drums regardless of the rotary press members composed of the press drum 27 or composed of the press rollers 120 and 121, or regardless of any types such as inner press roller type or an outer press roller type.

The stencil printing machine and control method of the same provides numerous advantages over prior art practices and which includes:

(A) The printing operations are greatly simplified. Unlike the prior art practices which need troublesome works prior to beginning the printing operations, the stencil printing machine and the control method will normally require to merely turn on the single-color printing key on the operation panel. In particular, in the stencil printing machine equipped with plural printing drums which allow printing in ink with plural printing colors, it is possible for the stencil printing machine to carry out printing with the number of printing colors which is less than the total number of the printing drums, wherein the number of the printing drums is expressed as N ($N \geqq 2$), by mounting the perforated stencil sheet or perforated stencil sheets, each of which is formed on the basis of image data of the original, onto the number of selected printing drums available for printing with the number (N−1) of printing colors while mounting the non-perforated stencil sheets onto the outer circumferential peripheries of the remaining non-selected printing drums. As a consequence, since the non-selected printing drums are covered with the non-perforated stencil sheets, the print medium will not be stained with printing ink even when the print sheet is brought into contact with the non-selected printing drums due to its resilience during the printing operation. In the event the rotary printing press member constitutes part of the transfer means for the print medium, even if the rotary printing press member is utilized as the transfer means, the print medium is prevented from being stained with printing ink, making it possible to easily execute printing with the number of the printing colors less than the number of the printing drums without stains caused in the print medium and without troublesome works.

(B) The presence of the rotary printing press member, composed of a single press drum located in the vicinity of the plural printing drums, allows the inner press roller, located inside each of the printing drums, to be brought into press engagement with the circumferential periphery of the screen, which forms part of each printing drum, to cause the screen to be expanded outward for thereby exerting printing pressure to the rotary printing press member, and the presence of the non-perforated stencil sheet, covered on the screen of the non-selected printing drum, allows printing ink to be prevented from being adhered to the print medium even when a portion of the print medium is brought into contact with the non-selected printing drum.

(C) The presence of the rotary printing press member, composed of a plurality of press rollers located in the vicinity of the plurality of printing drums, respectively, allows the press rollers to be selectively brought into press engagement with the printing drums, respectively to exert printing pressure thereto, and, even in this instance, since the outer circumferential periphery of the non-selected printing drum is covered with the non-perforated stencil sheet, printing ink is not transferred from the non-selected printing drum onto the press roller and the print medium even when the press roller is held in press engagement with the non-selected printing drum and a portion of the print medium is brought into contact with the non-selected printing drum.

(D) The provision of the single-color printing key in the stencil printing machine enables the single-color printing key to designate the printing color for thereby selecting the single-color printing mode, thereby allowing the perforated stencil sheet, which has been formed on the basis of the image data, to be mounted onto the selected printing drum while allowing the non-perforated stencil sheet to be mounted on the non-selected printing drum with a resultant ease of operation in single-color printing by mere operation of the single-color printing key.

What is claimed is:

1. A stencil printing machine comprising:

a plurality of printing drums each formed with a porous structure to allow a corresponding printing ink to permeate there through;

a stencil making unit for making perforated stencil sheets each having a perforated image area formed on the basis of an original and selectively making one or more nonperforated stencil sheets, with the perforated stencil sheets being supplied to and mounted onto ones of the printing drums; and a rotary printing press member located in close proximity to outer circumferential peripheries of the printing drums for imparting printing pressure thereto;

a print medium fed between the printing drums and the rotary printing press member such that the print medium is exerted with a given printing pressure to cause the printing drums'printing ink to permeate through respective perforated image areas of the stencil sheets to transfer the printing ink onto the print medium with a desired image pattern, wherein the stencil making unit allowing the perforated stencil sheet to be mounted onto selected one of the printing drums while allowing the non-perforated stencil sheet to be mounted onto non-selected one of the printing drums to prevent the non-selected drum s printing ink from being transferred to the print medium; and wherein, when the sum of the printing drums is expressed as N (N≧2), printing with a number of printing colors less than the sum of the printing drums is carried out by perforated stencil sheets mounted onto a number of the printing drums equal to the number of the printing colors while at the same time ones of the non-perforated stencil sheets are mounted onto the non-selected ones of the printing drums.

2. A stencil printing machine according to claim 1, further comprising a stencil making unit transfer device for selectively moving the stencil making unit toward the printing drums.

3. A stencil printing machine according to claim 1, wherein the rotary printing press member includes a single pressure drum located in close proximity to the plurality of printing drums, and further comprising inner press rollers located inside the respective printing drums to press the porous structures, formed by the outer circumferential surfaces of the respective printing drums, to cause the porous structures to expand outward for thereby exerting printing pressure thereto.

4. A stencil printing machine according to claim 1, wherein the rotary printing press member includes a plurality of press rollers located in close proximity to the plurality of printing drums, respectively, which are selectively moved to respective positions to be brought into press engagement with the respective printing drums to exert printing pressure thereto.

5. A stencil printing machine according to claim 1, further comprising a single-color printing start key, and a control section wherein, when the single-color printing start key is turned on to select a single color printing mode by designating a printing color to be printed, selected one of the printing drums for printing with the designated color is mounted with the perforated stencil sheet while mounting the non-perforated stencil sheet onto the non-selected one of the printing drums.

6. A stencil printing machine comprising:

a frame body;

a plurality of printing drums rotatably supported in the frame body and each including porous structures to allow a corresponding printing ink to permeate there through;

a stencil making unit for making perforated stencil sheets each having a perforated image area formed on the basis of an original and selectively making one or more non-perforated stencil sheets, with the perforated stencil sheets being supplied to and mounted onto ones of the plurality of printing drums;

ink supply means for supplying printing ink to the plurality of printing drums;

a rotary printing press member rotatably supported in the frame body in close proximity to outer circumferential peripheries of the printing drums; and a paper feed section located in the frame body in the vicinity of the rotary printing press member for supplying a print medium between the printing drums and the rotary printing press member to allow printing ink to be transferred from the printing drums through the respective perforated image areas to reproduce a desired image on the print medium;

wherein the stencil making unit allowing the perforated stencil sheet to be mounted onto selected-one of the printing drums while allowing the non-perforated stencil sheet to be mounted onto non-selected one of the printing drums to prevent the non-selected drum's printing ink from being transferred to the print medium; and wherein, when the sum of the printing drums is expressed as N (N≧2), printing with a number of printing colors less than the sum of the printing drums is carried out by perforated stencil sheets mounted onto a number of the printing drums equal to the number of the printing colors while at the same time ones of the non-perforated stencil sheets are mounted onto the non-selected ones of the printing drums.

7. A stencil printing machine according to claim 6, further comprising a stencil making unit transfer device for selectively moving the stencil making unit toward the printing drums.

8. A stencil printing machine according to claim 6, wherein the rotary printing press member includes a single press drum located in close proximity to the plurality of printing drums, and further comprising inner press rollers located inside the respective printing drums to press the porous structures, formed by the outer circumferential surfaces of the respective printing drums, to cause the porous structures to expand outward for thereby exerting printing pressure thereto.

9. A stencil printing machine according to claim 6, wherein the rotary printing press member includes a plurality of press rollers located in close proximity to the plurality of printing drums, respectively, which are moved to respective positions to be brought into press engagement with the respective printing drums to exert printing pressure thereto.

10. A stencil printing machine according to claim 6, further comprising a single-color printing start key, and a control section wherein, when the single-color printing start key is turned on to select a single color printing mode by designating a color to be printed, a selected one of the printing drums for printing in the designated color is mounted with the perforated stencil sheet while mounting the non-perforated stencil sheet onto a non-selected one of the printing drums.

11. A method of controlling a stencil printing machine having a plurality of printing drums each having a cylindrical porous structure to allow a corresponding printing ink to permeate there through, and a rotary printing press member located in close proximity to outer circumferential peripheries of the printing drums, the method comprising:

making a perforated stencil sheet having a perforated image area formed on the basis of an original and a non-perforated stencil sheet;

mounting the perforated stencil sheet onto a selected one of the printing drums;

mounting the non-perforated stencil sheet onto a non-selected one of the printing drums;

supplying printing ink to the selected printing drum; and supplying a print medium between the printing drums and the rotary printing press member to allow the printing ink to be transferred from the selected one of the printing drums through the perforated image area of the respective perforated stencil sheet to the print medium to reproduce a desired image thereon;

wherein, during printing, the non-perforated stencil sheet is mounted onto the non-selected one of the printing drums to prevent said non-selected drum's printing ink from being transferred to the print medium.

* * * * *